US006044815A

United States Patent [19]

de Ojeda

[11] Patent Number: 6,044,815

[45] Date of Patent: Apr. 4, 2000

[54] HYDRAULICALLY-ASSISTED ENGINE VALVE ACTUATOR

[75] Inventor: William de Ojeda, Chicago, Ill.

[73] Assignee: Navistar International Transportation Corp., Chicago, Ill.

[21] Appl. No.: 09/152,497

[22] Filed: Sep. 9, 1998

[51] Int. Cl.[7] ..... F01L 9/02

[52] U.S. Cl. ..... 123/90.12; 123/90.11; 251/30.01

[58] Field of Search ..... 123/90.11, 90.12; 251/30.01

[56] References Cited

U.S. PATENT DOCUMENTS

| | | | |
|---|---|---|---|
| Re. 35,303 | 7/1996 | Miller et al. . | |
| 5,012,778 | 5/1991 | Pitzi . | |
| 5,191,867 | 3/1993 | Glassey . | |
| 5,224,683 | 7/1993 | Richeson | 251/30.01 |
| 5,248,123 | 9/1993 | Richeson et al. | 251/29 |
| 5,287,829 | 2/1994 | Rose | 123/90.12 |
| 5,339,777 | 8/1994 | Cannon . | |
| 5,392,749 | 2/1995 | Stockner . | |
| 5,410,994 | 5/1995 | Schechter . | |
| 5,419,301 | 5/1995 | Schechter . | |
| 5,421,359 | 6/1995 | Meister et al. . | |
| 5,448,973 | 9/1995 | Meyer . | |
| 5,456,221 | 10/1995 | Schechter . | |
| 5,456,222 | 10/1995 | Schechter . | |
| 5,456,223 | 10/1995 | Miller et al. . | |
| 5,529,030 | 6/1996 | Rose | 123/90.12 |
| 5,595,148 | 1/1997 | Letsche et al. . | |
| 5,636,602 | 6/1997 | Meister . | |
| 5,638,781 | 6/1997 | Sturman . | |

*Primary Examiner*—Weilun Lo
*Attorney, Agent, or Firm*—Dennis Kelly Sullivan; Jeffrey P. Calfa

[57] ABSTRACT

A hydraulically-assisted engine valve actuator and method for assisting in the actuation of an engine valve includes a translatable pilot valve that is operably coupled to and controlled by a pilot valve positioning system. A servo piston is in fluid communication with the pilot valve and is operably coupled to the engine valve. The pilot valve positioning system controls translation of the pilot valve to meter hydraulic fluid under pressure to and from the servo piston. The hydraulic fluid under pressure causes the servo piston to closely follow the translation of the pilot valve to effect a desired profile of translational opening and closing motion of the engine valve.

41 Claims, 10 Drawing Sheets

FIG. 2
OPEN STROKE
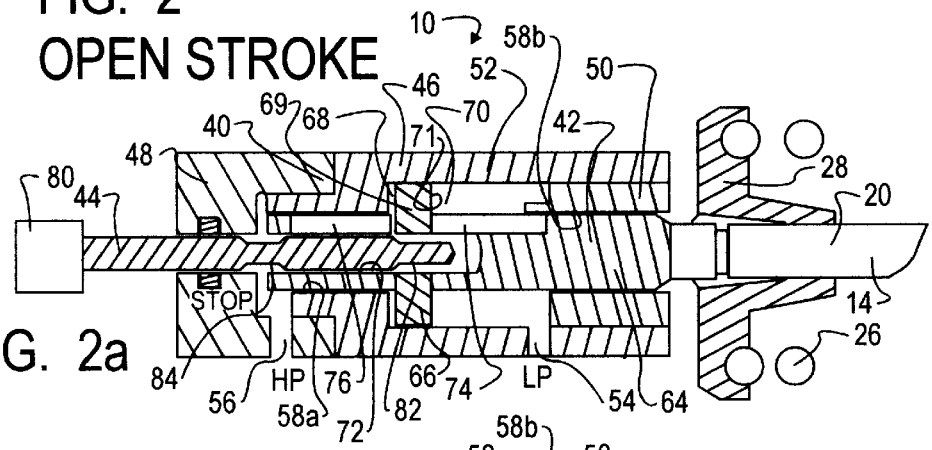
FIG. 2a
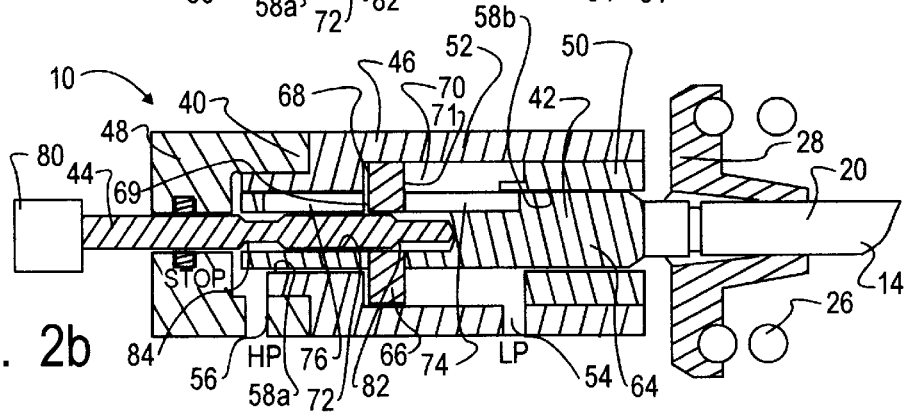
FIG. 2b
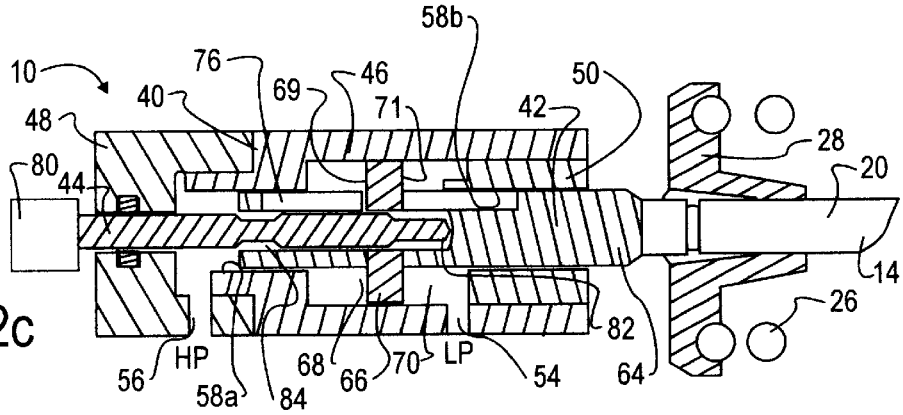
FIG. 2c
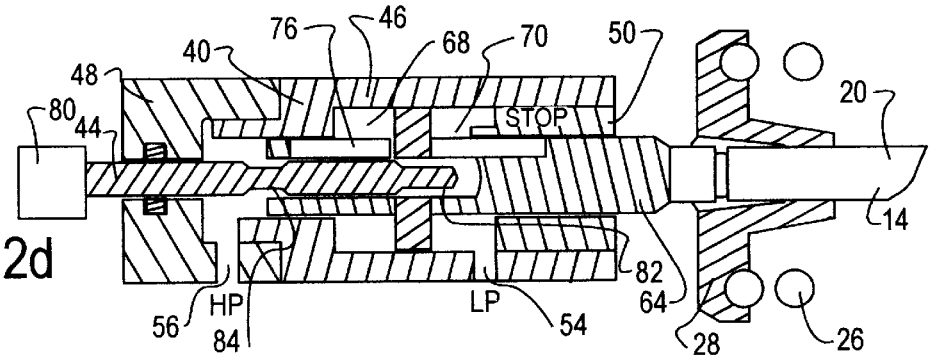
FIG. 2d FIG. 3
CLOSE STROKE
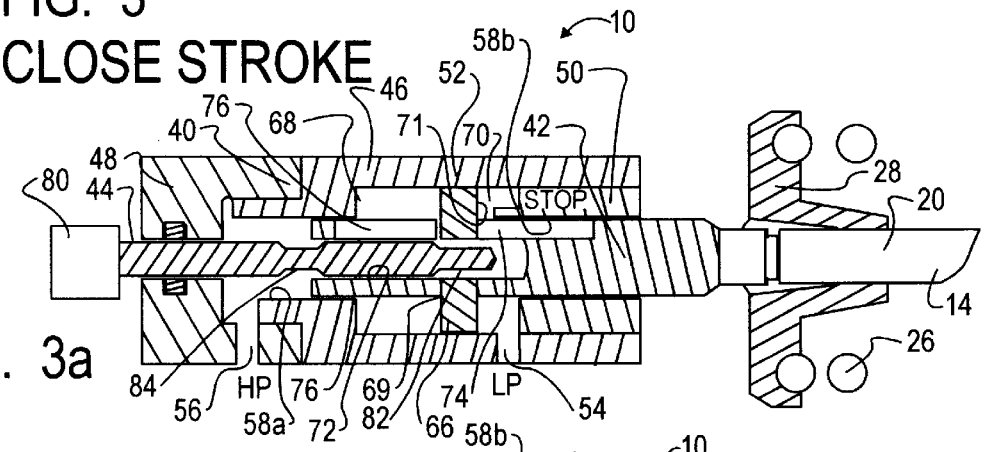
FIG. 3a
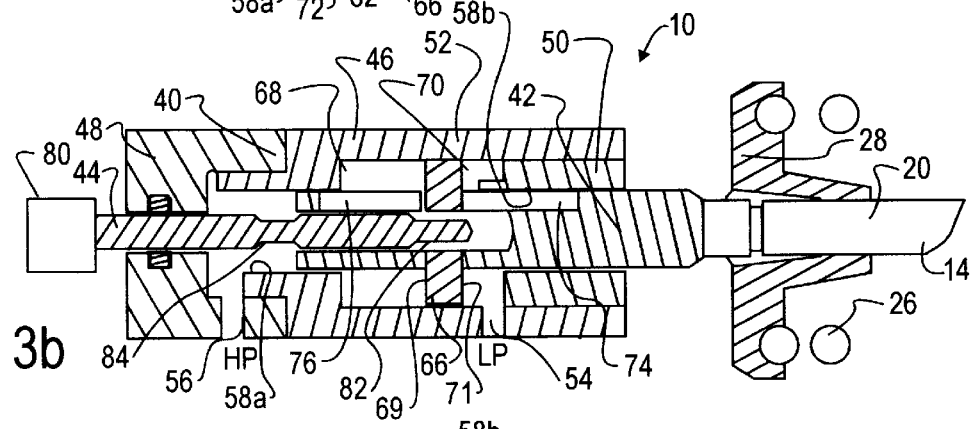
FIG. 3b
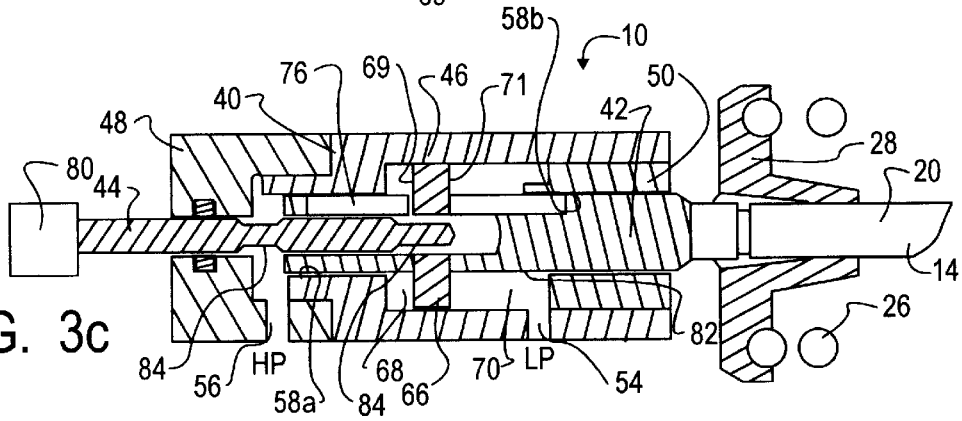
FIG. 3c
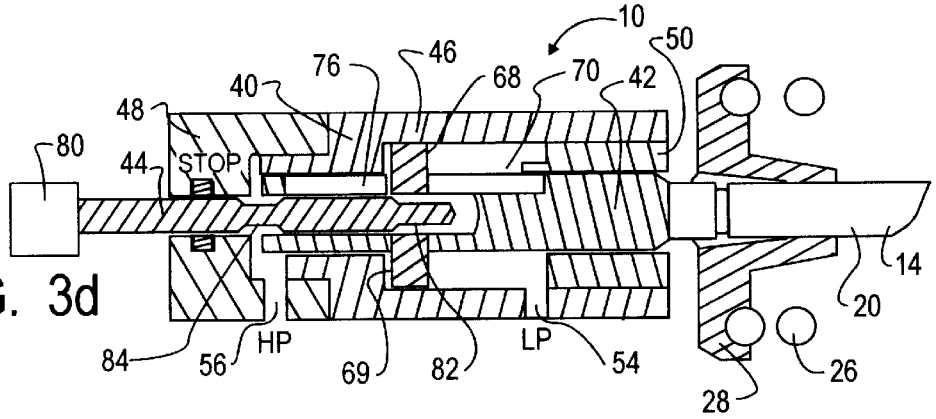
FIG. 3d CONTROL NEEDLE AND ENGINE VALVE POSITION
IN
.5
.4
.3
.2
0
0
.01
.02
.03
.04
TIME
PRIOR ART
NEEDLE MOTION
ACTUATOR MOTION
ENGINE PISTON ACTUATOR FLOW RATE
GPM
10
0
-10
-20
-30
-40
-50
0
.01
.02
.03
.04
TIME
ACTUATORFLOW PISTON FORCES
LB
1000
750
500
250
0
-250
-500
0
.01
.02
.03
.04
TIME
ACTUATORFLOW
SPRINGFORCE ACTUATOR PRESSURES
PSIA
2000
1600
1200
800
400
0
0
.01
.02
.03
.04
TIME
ACTUATOR PE
ACTUATOR PR

HYDRAULICALLY-ASSISTED ENGINE VALVE ACTUATOR

TECHNICAL FIELD

The present invention relates to internal combustion engines. More particularly, the present invention relates to hydraulic engine valve actuation.

BACKGROUND OF THE INVENTION

It is desirable that a hydraulically-assisted engine valve actuator provide for flexible engine valve operation under a wide band of engine operating conditions. The hydraulically-assisted engine valve actuator should provide for variable valve timing of closing and opening and variable lift as desired in order to achieve the greatest engine efficiencies. Presently, hydraulic fluid is supplied to hydraulically actuated valves through tubes commonly called rails. Valve motion profiles in current hydraulic actuation designs depend on a pre-established constant value of oil pressure at the supply rails because rail pressures cannot be adjusted fast enough to modulate valve profiles. The constant rail pressure values result in constant valve profiles regardless of engine rpm.

Present hydraulic actuation schemes add complexity to the engine design. Some hydraulic actuation designs rely on additional hydraulic supply rails at constant pressure levels. Further, hydraulic actuation that relies on on/off solenoid (spool or poppet) valve operations require engine valve position sensors for reliable timing of the solenoids and for safe operation. The plurality of sensors required, further adds to the engine complexity.

A hydraulically-assisted engine valve actuator should provide for uniform valve actuation over a wide range of hydraulic fluid temperatures. Present hydraulic actuation schemes typically rely on mechanical damping mechanisms for seating in order to prevent the valve from seating too rapidly. Such mechanisms are typically very dependent on oil temperature, leading to nonuniform valve actuation characteristics.

SUMMARY OF THE INVENTION

The hydraulically-assisted engine valve actuator of the present invention allows for flexible engine valve operation: variable valve timing of closing and opening and variable valve lift. Further, the mechanical components needed to effect the hydraulic actuation are relatively simple, thereby minimizing the additional engine components required. No sensors or mechanical damping mechanisms are needed. Additionally, the hydraulic actuation of the present invention is designed to provide for uniform actuation over a wide range of hydraulic fluid temperatures.

The foregoing advantages of the present invention are effected by the use of fine needle control. The fine needle control provides for modulation of engine valve profiles: varying engine profiles at varying engine speeds, varying the shape of the profiles at a given rpm. The present invention further allows aggressive valve openings and closings which translates into better volumetric efficiency of the engine.

The hydraulically-assisted engine valve actuator of the present invention is not sensitive to pressure variation in the high-pressure rail, that is, the modulation of engine valve motion is capable of tolerating a variation of pressure (above a predetermined threshold pressure) in the high-pressure rail.

The device of the present invention only requires one high-pressure supply line. The low-pressure line in an embodiment of the present invention is shared with the existing lube oil supply. In the case of engines with a fuel injection system incorporating a high-pressure rail, the same pressure supply is used for valve actuation in order to further minimize the added components to the engine.

In the case of the present invention, the output, i.e. the engine valve position, very closely follows the input to the hydraulic actuator. Therefore, the device of the present invention does not require the added complexity of requiring a sensor to measure engine valve position for feedback control. Accurate control of valve seating is attained by accurate control of the needle at the end of stroke.

The present invention further provides very good cold temperature operating performance despite the hydraulic fluid preferably being lubricating oil. The proportional flow areas of the hydraulic fluid passages are not so small as to compromise performance under variable operating temperatures, especially important in cold temperature operation since the viscosity of hydraulic fluid, particularly lubricating oil, is significantly higher when the engine is cold than after it has warmed up.

Further, the mechanical components that are required for valve actuation by the present invention do not significantly increase the engine complexity, i.e., very few modifications to an existing cylinder head would be needed in order to incorporate the valve actuator assembly of the present invention.

The present invention is a hydraulically-assisted engine valve actuator for moving an engine valve between open and closed positions relative to an engine cylinder head and includes a translatable pilot valve that is operably coupled to and controlled by a pilot valve positioning system. A servo piston is in fluid communication with the pilot valve and the servo piston is operably coupled to the engine valve. The pilot valve positioning system controls translation of the pilot valve to meter hydraulic fluid under pressure to and from the servo piston. The hydraulic fluid under pressure causes the servo piston to closely follow the translation of the pilot valve to effect a desired profile of translational opening and closing motion and lift of the engine valve.

BRIEF DESCRIPTION OF THE DRAWINGS

FIGS. 2*a*–2*b* depict the valve opening cycle. Specifically, FIG. 2*a* is a side elevational view in section of the valve actuator with the actuator and the valve in the closed retracted configuration;

FIG. 2*b* is a side elevational view in section of the valve actuator with the actuator needle commencing translation to the right and the valve in the closed retracted configuration;

FIG. 2*c* is a side elevational view in section of the valve actuator with the actuator needle in a rightward position and the valve approaching the open extended configuration;

FIG. 2*d* is a side elevational view in section of the valve actuator with the actuator needle and valve stopped in the open extended configuration;

FIGS. 3*a*–3*b* depict the valve closing cycle. Specifically, FIG. 3*a* is a side elevational view in section of the valve actuator with the actuator needle and the valve in the open extended configuration;

FIG. 3*b* is a side elevational view in section of the valve actuator with the actuator needle and the valve in the open extended configuration, the actuator needle having translated to the left exposing the extender chamber to low pressure hydraulic fluid;

FIG. 3*c* is a side elevational view in section of the valve actuator with the valve in transition between the open extended configuration and the closed retracted configuration, the actuator needle having translated to the left exposing the extender chamber to low pressure hydraulic fluid;

FIG. 3*d* is a side elevational view in section of the valve actuator with the actuator needle and valve in the closed retracted configuration;

FIG. 4*a* is a graph of actuator and valve displacement over time;

FIG. 4*b* is a graph of the flow of high pressure hydraulic fluid to the actuator over time;

FIG. 5*a* is a side elevational view in section of the valve actuator with the actuator and valve in the closed retracted configuration just prior to the valve downstroke;

FIG. 5*b* is a side elevational view in section of the valve actuator with the actuator needle commencing translation to the downward and the valve in the closed retracted configuration;

DETAILED DESCRIPTION OF THE PREFERRED EMBODIMENT

Figure 1:
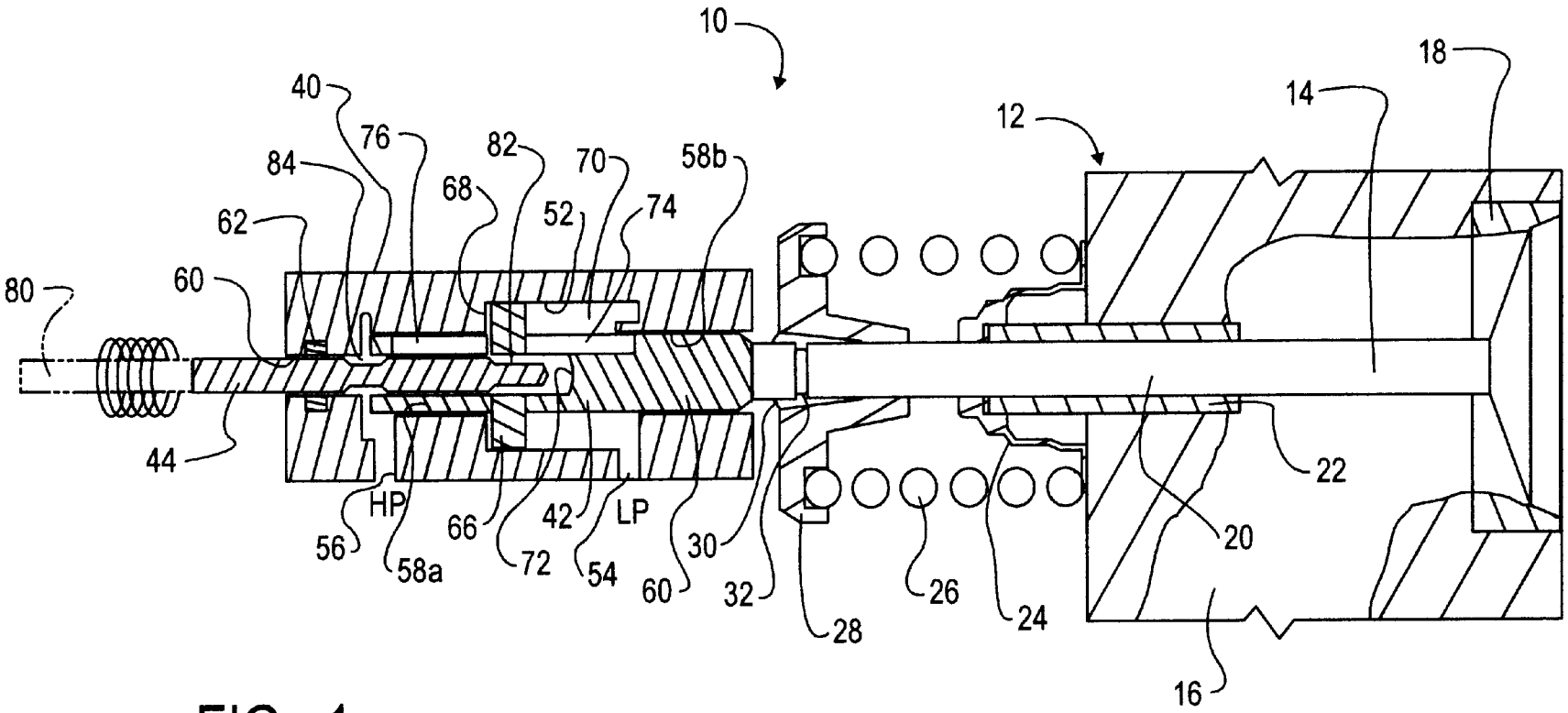
FIG. 1 is a side elevational view in section of the hydraulically-assisted engine valve actuator of the present invention coupled to an engine valve.

The hydraulically assisted engine valve actuator of the present invention is shown generally at 10 in the figures. In FIG. 1, actuator 10 is depicted coupled to an engine head 12.

The engine head 12 has a valve 14 translatably disposed therein. The valve 14 opens and closes an intake/exhaust passageway 16. Intake/exhaust passageway 16 is either an intake passageway or an exhaust passageway depending on whether the valve 14 is an intake valve or an exhaust valve. For the purposes of the present invention, valve 14 can be either an intake or an exhaust valve.

In the depiction of FIG. 1, valve 14 is in the closed configuration seated on valve seat 18. An elongate cylindrical valve stem 20 is translatably borne within a valve guide 22. A valve seal 24 mounted on the engine head 12 prevents fluids from escaping around the valve stem 20.

A coil valve spring 26 is disposed concentric with the valve stem 20 and has a first end bearing on the engine head 12. The second end of the valve spring 26 is retained within a valve rotator 28. The valve spring 26 is preferably maintained in a state of compression between the valve rotator 28 and the engine head 12 when the valve 14 is either in the open or closed configurations. A valve keeper 30 has a portion thereof disposed within a keeper groove 32 formed circumferential to the valve stem 20. The valve keeper 30 holds the valve rotator 28 in engagement with the valve stem 20.

The hydraulic actuator 10 of the present invention includes three major subcomponents: actuator casing 40, actuator piston 42, and needle 44.

Referring to FIG. 2*a*, the actuator casing 40 is preferably formed of three components: a centrally disposed casing body 46, a casing cap 48, and a casing insert 50. Referring again to FIG. 1, the casing body 46 of the actuator casing 40 has a cylinder bore 52 defined concentric with the longitudinal axis of the actuator casing 40. A low pressure (LP) fluid passageway 54 is defined between the casing body 46 and the casing insert 50. LP fluid passageway 54 extends from the exterior of the actuator casing 40 to intersect the cylinder bore 52.

A piston bore 58*a*, 58*b* is defined concentric with the longitudinal axis of the actuator casing 40 and the casing body 46 and casing insert 50, respectively. The piston bore 58*a*, 58*b* is generally cylindrical, having a diameter that is substantially less than the diameter of the cylinder bore 52. A high pressure (HP) fluid passageway 56 is defined between the casing body 46 and the casing cap 48. HP fluid passageway 56 intersects the piston bore 58*a*.

A needle bore 60 is defined in the casing cap 48 of the actuator casing 40. An O-ring seal groove 62 is defined circumferential to the needle bore 60.

The actuator piston 42 has a cylindrical piston body 64 and a piston head 66. The piston body 64 has a generally elongate cylindrical shape. The piston body 64 is operably coupled at a first end to the end of the valve stem 20 of the valve 14. A needle bore 72 is defined in the second end of the piston body 64. The needle bore 72 extends approximately half the longitudinal dimension of the piston body 64. The needle bore 72 is concentric with the longitudinal axis of the actuator piston 42. The piston body 64 is slideably disposed within the piston bore 58*a*, 58*b*.

The piston head 66 is a generally cylindrical shape. The diameter of the piston head 66 is substantially greater than the diameter of the piston body 64. The piston head 66 is disposed within the cylinder bore 52 defined within the actuator casing 40. As depicted in FIG. 1, the piston head 66 divides the cylinder bore 52 into a left variable volume extender chamber 68 and a right, variable volume, retractor chamber 70. The piston body 64 is translatable within the piston bore 58*a*, 58*b*, and the piston head 66 is translatable therewith within the cylinder bore 52. Such translation in the cylinder bore 52 acts to simultaneously change the volume of the extender chamber 68 and the retractor chamber 70, increasing the volume of one chamber while decreasing the volume of the other chamber.

A plurality of fluted passageways 74 extend through the piston body 64 to accommodate the flow of hydraulic fluid from the LP fluid passageway 54 to the extender chamber 68 (depending on the position of the needle 44) and to the retractor chamber 70. A plurality of fluted passageways 76 extend through the piston body 64 to accommodate the flow of hydraulic fluid from the HP fluid passageway 56 to the extender chamber 68.

The needle 44 of the hydraulic actuator 10 is a generally elongate cylindrical rod. The needle 44 is disposed partially in the needle bore 72 defined in the piston body 64. The needle 44 extends through the needle bore 60 defined in the casing cap 48 of the actuator casing 40. An O-ring disposed in the O-ring seal groove 66 effects a seal between the needle 44 and the needle bore 60. The needle 44 is slideably disposed within both the needle bore 60 and the needle bore 72.

The needle 44 extends beyond the casing cap 48 and is operably coupled to a needle positioning mechanism 80. In the depiction of FIG. 1, needle positioning mechanism 80 is a solenoid. Needle positioning mechanism 80 may also be the lobe of a cam or a stepper motor or other suitable positioner as desired.

The inward directed end of the needle 44 is shaped to form a spool valve including a first end groove 82. Groove 82 has a diameter that is substantially less than the inside diameter of the needle bore 72, thereby defining a fluid passageway between the first end groove 82 and the needle bore 72. A second groove 84 is defined at approximately the center point along the longitudinal axis of the needle 44. The second groove 84 also has a diameter that is substantially less than the diameter of needle bore 72, thereby defining a fluid passageway between the second groove 84 and the needle bore 72.

Operation of Invention

In operation, the hydraulically assisted engine valve actuator 10 relies on low and high pressure fluid. A source of low pressure hydraulic fluid, such as engine lubricating oil, under pressure as the oil is circulated through the engine for lubricating purposes, is operably coupled to the LP fluid passageway 54. A source of high pressure fluid, such as engine oil under pressure as necessary to operate the engine fuel injectors, is operably coupled to the HP fluid passageway 56. Such a high pressure source is described in connection with a hydraulically-actuated, electronically-controlled unit fuel injector system in U.S. Pat. Nos. 5,191,867 and 5,392,749 which are incorporated by reference herein. Translational movement of the needle 44 responsive to input from the needle positioning mechanism 80 distributes hydraulic fluid into and out of the extender chamber 68 and the retractor chamber 70 defined by the position of the piston head 66 of the actuator piston 42 to act on the piston head 66 in such a way (described in detail in the following section) that the actuator piston 42 and the valve 14 position very closely follow the translational movement of the needle 44.

The actuator piston 42 acts directly on the engine valve 14, the engine valve 14 being biased to the closed position by the valve spring 26. The valve spring 26 always exerts a leftward force on the actuating piston 42, as depicted in FIGS. 1–3*d*. The actuator piston 42 has sufficient rightward directed force, when motivated by high pressure hydraulic fluid, to overcome the opposing bias of the spring 26 and the opposing force of any combustion forces acting on the engine valve 14 to open the valve 14.

Translational motion of the needle 44 requires a minimum force exerted by the needle positioning mechanism 80 and may be effectively controlled to describe a prescribed profile. In a preferred embodiment, the force is less than 12 pounds and more preferably is substantially about 6 pounds. The translational position of the needle 44 controls the position of the engine valve 14. Positioning the valve 14 requires a much larger force input than the force input needed to position the needle 44. This much larger force input is available by means of the high pressure hydraulic fluid acting in the extender chamber 68 acting on the actuator piston 42. In this regard, the actuator 10 is a servo follower system. Control is maintained of the needle 44 by the needle positioning system 80. The needle 44 acts as a servo pilot with the actuator piston 42 being the servo main stage and following the needle 44. The force needed to actuate needle 44 is relatively very small compared to the forces that follow the needle 44. In a preferred embodiment, the needle 44 is controllable with a six pound force. This greatly reduces the mass and complexity of the components needed to effect actuation of the valve 14.

FIGS. 2*a*–2*d* depict the opening stroke of the valve 14, sequentially progressing from the closed position in FIG. 2*a* to the open position in FIG. 2*d*. In FIG. 2*a*, the engine valve 14 is initially resting against the valve seat 18 through action of the bias exerted by the valve spring 26. The needle 44 and actuator piston 42 are fully retracted to the leftmost position. Low-pressure fluid enters the LP fluid passageway 54 and flows through the fluted passageways 74 to fill the retractor chamber 70 and then flows through the fluid passageway defined by the first end groove 82 to flood the extender chamber 68 of the actuator piston 42. With low pressure hydraulic fluid acting on both sides 69, 71 of the piston head 66, the actuator piston 42 is in a state of hydraulic equilibrium. No hydraulically generated force is acting to counter the force of the spring 26.

Referring to FIG. 2*b*, the needle positioning mechanism 80 translates the needle 44 rightward. First, such translation advances the shoulder of the first end groove 82 of the needle 44, sealing the extender chamber 68 from the retractor chamber 70. Second, as the needle 44 continues to translate rightward, the needle 44 allows the high pressure fluid supply from HP fluid passageway 56 to flow through the second groove 84 and through the fluted passageways 76. The high pressure fluid communicates with the extender chamber 68 and bears on the side 69 of the piston head 66 that forms a portion of the extender chamber 68. It should be noted that the low pressure fluid is always acting on the side 71 of the piston head that forms a portion of the retractor chamber 70. The high pressure oil in the extender chamber 68 drives the actuator piston 42 and engine valve 14 to the open position, overcoming the opposing force of the spring 26 and the opposing force of the low pressure fluid acting on the side 71 of the piston head 66 that forms a portion of the retractor chamber 70. In a preferred embodiment, the high pressure fluid operates in a pressure range of approximately 450 psi to 3000 psi and the low pressure fluid operates at a pressure of approximately 50 psi.

The rate of rightward translational displacement of the needle 44 determines the area of the fluid passageway opening between the second groove 84 and the fluted passageways 76 to the extender chamber 68 and thereby meters the high pressure fluid from the high pressure supply at the HP fluid passageway 56 that is available to act upon the side 69 of the piston head 66 that forms a portion of the extender chamber 68. This metering permits control of the opening profile of the valve 26, as desired. The faster the needle 44 continues to move rightward, the less the throttling effected on the high-pressure oil and the greater the volume of the high pressure fluid supply that the needle 44 allows to communicate with the extender chamber 68 to act upon the side 69 of the piston head 66 that forms a portion of the extender chamber 68. The high pressure fluid in the extender chamber 68 drives the actuator piston 42 and engine valve 14 to the opening position, overcoming the force of the spring 26 and the opposing force of the low pressure fluid acting on the side 71 of the piston head 66 that forms a portion of the retractor chamber 70. Conversely, the slower the displacement of the needle 44, the less area of the fluid passageway defined by the second groove 84 that is open to the fluted passageways 76 and thence to the extender chamber 68 and the greater the throttling effect on the high pressure oil. The resulting lower high pressure oil volume in the extender chamber 68 results in less force available to overcome the force of the spring 26 and the opposing force of the low pressure fluid acting on the side 69 of the piston head 66 that forms a portion of the retractor chamber 70. This in turn results slower movement of the actuator piston 42 and in a valve profile that is characterized by slower opening movement of the engine valve 14.

Referring to FIG. 2*d*, when the needle 44 is brought to a stop at its point of greatest rightward translation, the pressure in the extender chamber 68 and the inertia of the actuator piston 42 cause the actuator piston 42 and valve 14 to continue their rightward motion for a short distance until the shoulder of the second groove 84 of the needle 44 seals the fluted passageway 76, preventing further high pressure fluid from affecting the extender chamber 68 of the piston actuator 42. A balance then ensues between the fluid trapped in the extender chamber 68 and the opposing bias of the spring 26.

The closing stroke of the valve 14 is depicted sequentially in FIGS. 3*a*–3*d*. Referring to FIG. 3*a*, the needle 44 and actuator piston 42 are initially positioned such that the engine valve 14 is unseated at some lift (at least partially open) as a result of the last action in the open stroke referred to above. The needle 44 seals the extender chamber 68 from both the high and low pressure oil supplies, as previously described in reference to FIG. 2*d*.

Referring to FIG. 3*b* the needle positioning mechanism 80 retreats the needle 44, causing leftward translation of the needle 44. The movement of the needle 44 opens the fluid passageway defined circumferential to the first end groove 82 to fluidly connect the extender chamber 68 to the retractor chamber 70. As previously indicated, the retractor chamber 70 is always exposed to the low pressure oil supply at LP fluid passageway 54. The extender chamber 68 is isolated from the high pressure oil at HP fluid passageway 56 by the needle 44 proximate the second groove 84. The second groove 84 is positioned to isolate the fluted passageways 76 from the high pressure fluid supply at passageway 54. The high pressure fluid in the extender chamber 68 flows into the retractor chamber 70 until extender chamber 68 and the retractor chamber 70 are in a state of hydraulic pressure equilibrium. The force of the spring 26, which is always acting on the actuator piston 42, drives the engine valve 14 and actuator piston 42 leftward towards the closed position, as depicted in FIG. 3*c*.

The rate at which the needle 44 retreats is determined by the needle positioning mechanism 80 and determines the area of the fluid passageway fluidly communicating between the retractor chamber 70 and the extender chamber 68, thereby metering the high pressure fluid flow from the extender chamber 68 to the retractor chamber 70. The force of the spring 26 acts to pull the engine valve 14 and actuator piston 42 to the closed position as the high pressure fluid is discharged from the extender chamber 68. The faster that the needle 44 is displaced leftward, the larger the area and the faster the rate at which the oil is discharged from the extender chamber 68 to the retractor chamber 70. The oil in the extender chamber 68 must be displaced in order for the valve A to close. The rate of displacement controls the rate of valve 14 closure. Control of the rate of translation of the needle 44 thereby affords control of the profile of the closing of the valve 14.

When the needle 44 is brought to a stop, as depicted in FIG. 3*d*, the force of the spring 26 and of inertia act to continue the leftward motion of the actuator piston 42 towards the closed position for a small amount of travel after needle 44 stoppage. Such travel continues until the extender chamber 68 is sealed from the retractor chamber 70 by the shoulder of the first end groove 82. A balance then ensues between the fluid pressure in the extender chamber 68 and the retractor chamber 70. The force of the spring 26 continues to act on the actuator piston 42 and the valve 14, maintaining the valve 14 in the seated closed position.

Figures 4, 4A, 4B, 4C, 4D:
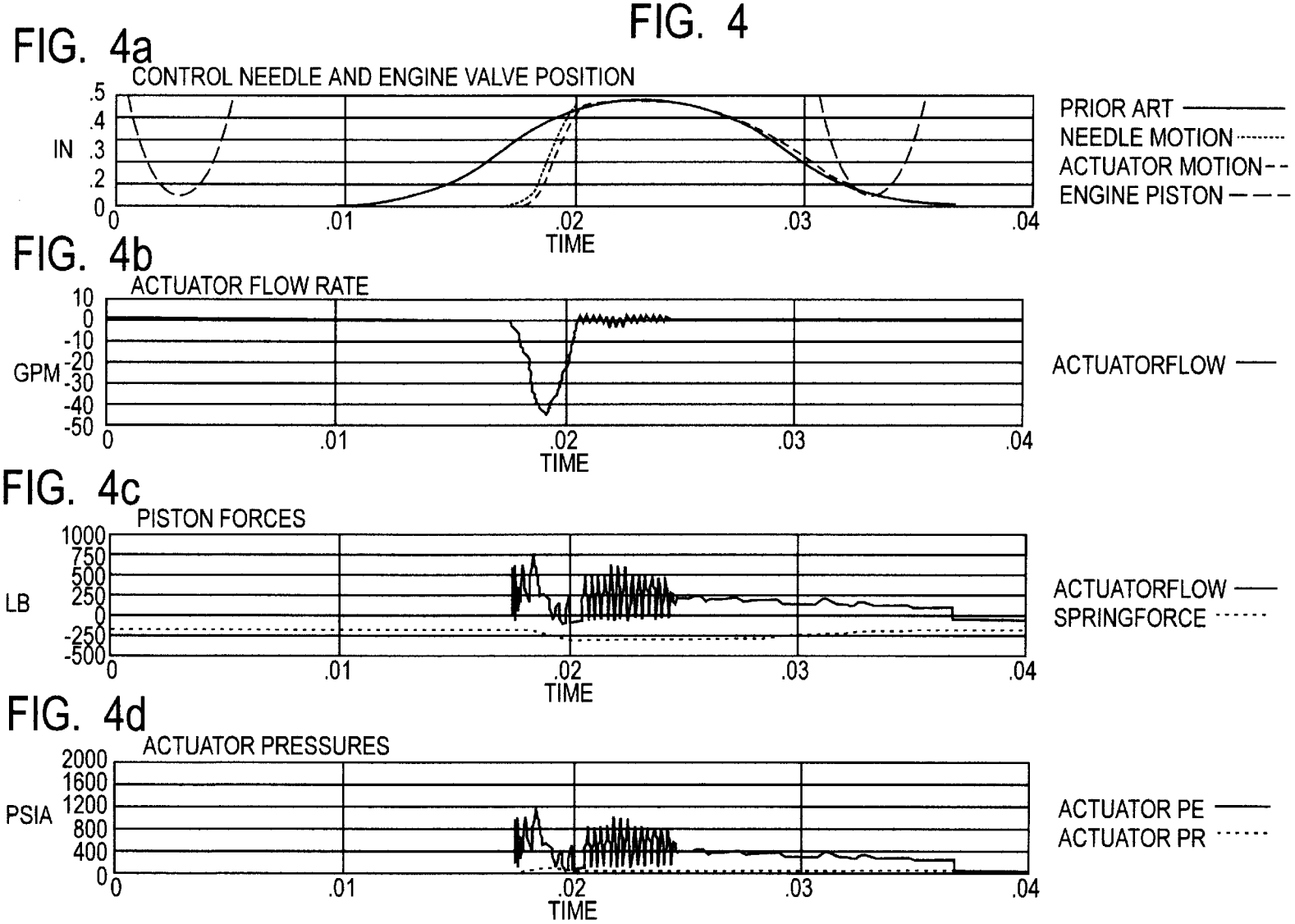
FIGS. 4*a*–4*b* depict various actuator and valve parameters on a common time base, the valve being actuated by the valve actuator of the present invention. Specifically.
FIG. 4*c* is a graph of force on the actuator piston and the valve spring force over time.
FIG. 4*d* is a graph of actuator pressure in the extender and retractor chambers over time.

FIGS. 4*a*–4*d* depict a comparison of a cam valve train engine exhaust valve 14 profile with a profile that incorporates an aggressive valve opening around bottom dead center. The FIGS. 4*b*–4*d* depict actuator flow rate, piston forces, and actuator pressures corresponding to motion depicted in FIG. 4*a*. The FIG. 4*a* shows piston motion profile, cam valve train profile, needle position, and response of the piston actuator and engine valve to the needle position input. FIG. 4*a* depicts how closely the output in the form of motion of valve 14 tracks the input in the form of needle 44 position, thus obviating the need for a sensor to track position of the valve 14. FIG. 4*b* depicts flow rate of high pressure oil needed to effect a valve opening and closing cycle. FIG. 43*c* depicts the force of the high pressure oil acting on the actuator 42 in comparison to the opposing force of the spring 26. FIG. 4*d* indicates that the pressure needed to keep the valve open stabilizes at about 400 psi after 0.02 seconds. Virtually any high pressure hydraulic fluid that is above the threshold of about 400 psi is adequate to cause the actuator 10 to function as designed.

Turning now to FIGS. 5*a*–5*f*, a hydraulic schematic of the operation of the hydraulic actuator 10 is depicted sequentially through a downstroke of the valve 14 and an upstroke of the valve 14. In order to effect the downstroke of the valve 14, there are two downward motions that must be considered. First, the actuator piston 42 is coupled to the valve 14 and drives the valve 14 in the downward direction as depicted. Second, the needle 44 translates within the needle bore 72 defined in the actuator piston 42 under the influence of the needle positioning mechanism 80.

Figure 5A:
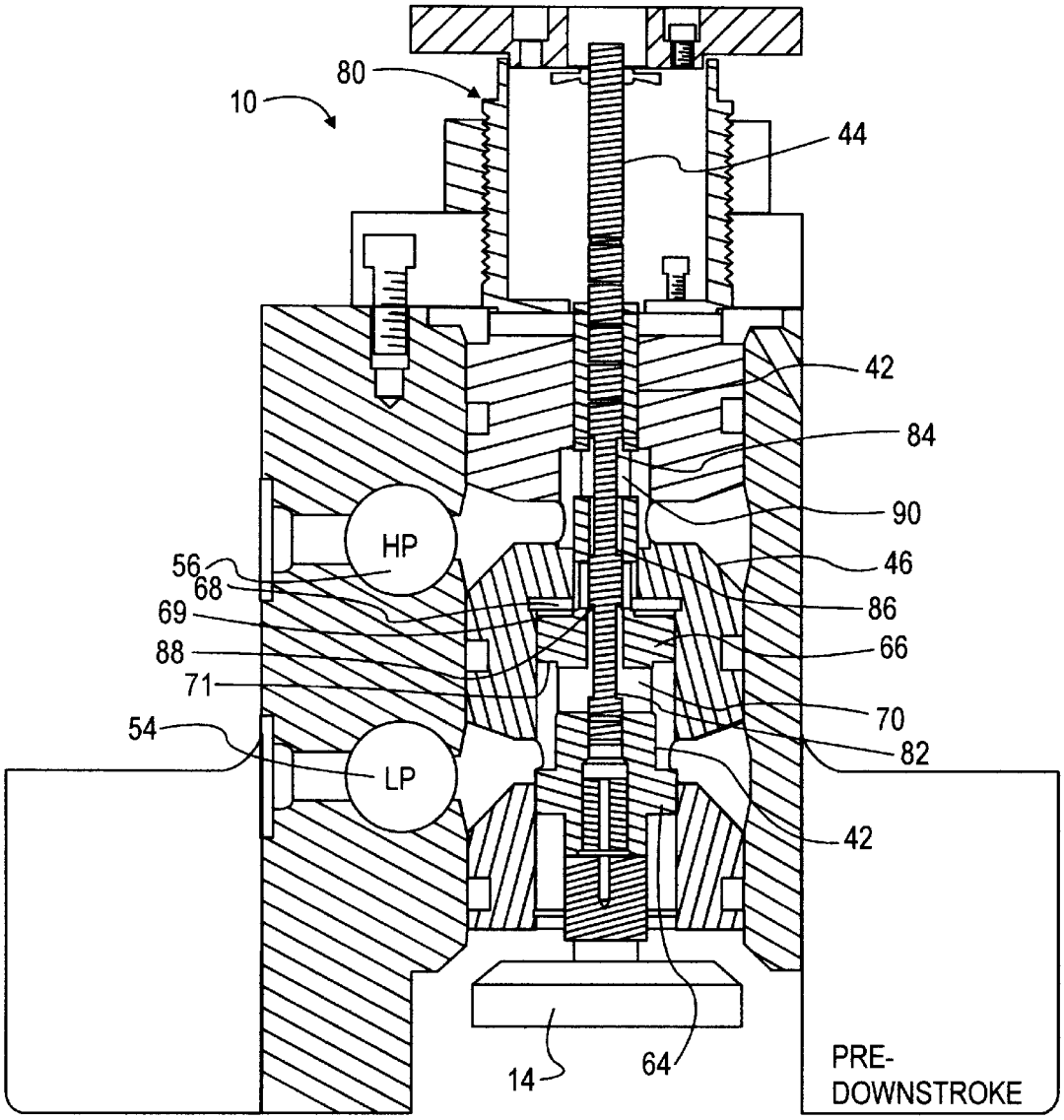
FIGS. 5*a*–5*b* are hydraulic schematics depicting the valve opening cycle and the valve closing cycle in sequence. Specifically.

Prior to commencement of the downstroke of the valve 14, the actuator piston 42 and the needle 44 are in their fully retracted and upward position as depicted in FIG. 5*a*. High pressure lubricating oil available at high pressure fluid passageway 56 from a high pressure rail floods the chamber 90 and flow into the second groove 84. The second groove 84 is sealed at its downward most end by the shoulder 86 of the needle 44 sealingly engaging the actuator piston 42.

Low pressure engine lubricating oil available at low pressure fluid passageway 54 from a high pressure rail floods the retractor chamber 70. The low pressure engine lubricating oil is prevented from entering the first groove 82 by a sealing engagement of the shoulder 88 of the needle 44 with the actuator piston pin 42.

The valve 14 is kept in its fully upward seated disposition, as depicted in FIG. 5*a*, by the action of the low pressure engine lubricating oil acting on the retractor surface 71 of the piston head 66, in combination with the bias exerted by the valve spring 26.

Figure 5B:
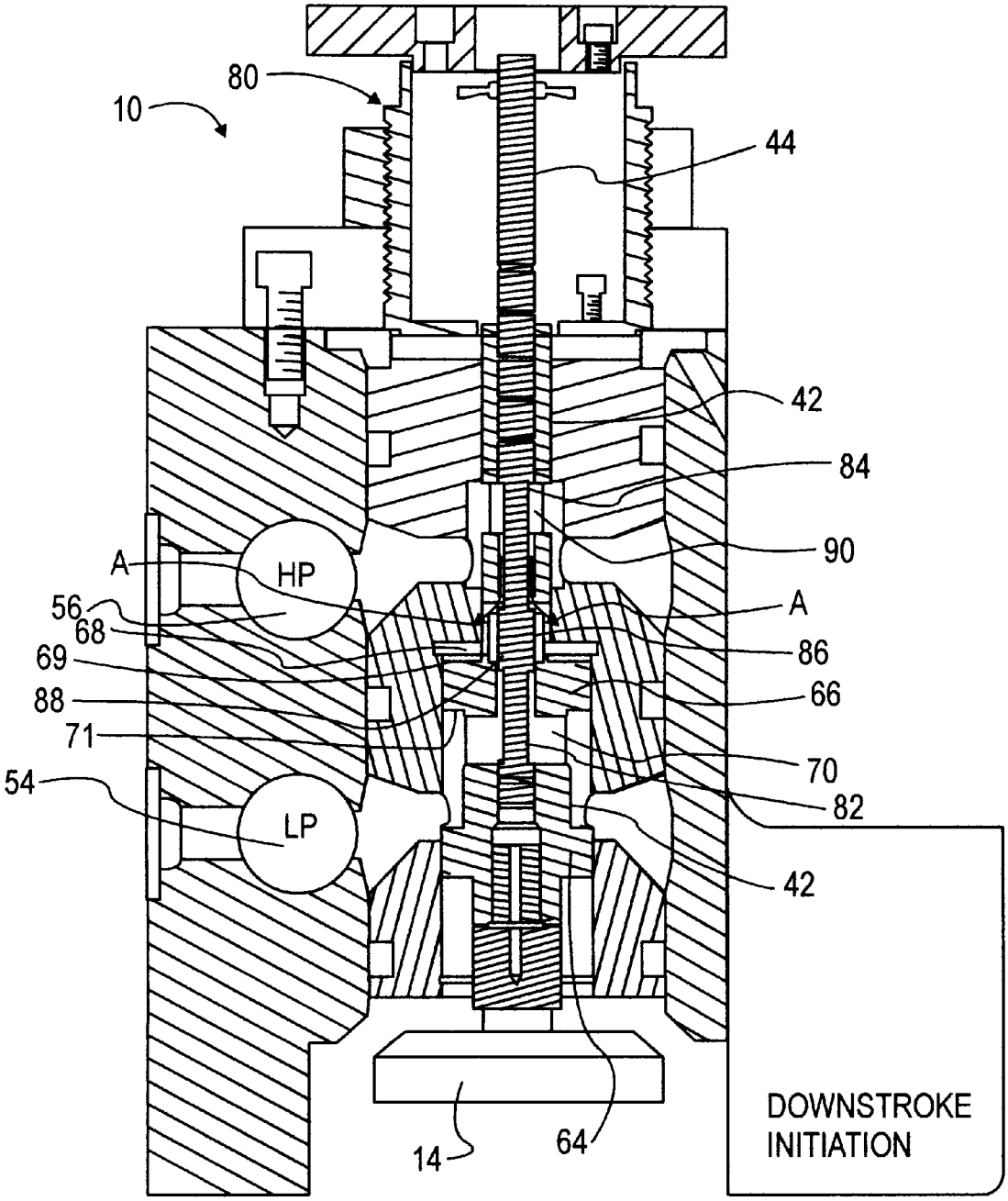

FIG. 5*b* depicts the initiation of the downstroke of the valve 14. In FIG. 5*b*, the needle 14 has translated downward relative to the actuator piston 42 under the influence of the needle positioning mechanism 80. Such downward translation backs the shoulder 86 of the needle 44 out of engagement with the actuator piston 42 to create a fluid passageway through the second groove 84 to the extender chamber 68.

High pressure engine lubricating oil flows through the second groove 84 into the extender chamber 68 and bears on the extender surface 69 of the piston head 66. The force exerted by the high pressure engine lubricating oil is sufficient to overcome the countering force exerted by the engine pressure lubricating oil acting on the retractor surface 71 in combination with the bias exerted by the valve spring 26. Accordingly, translation of the actuator piston 42 and the coupled valve 14 commences downward closely trailing the translation of the needle 44. The flow of high pressure engine lubricating oil into the extender chamber 68 is depicted by arrows A. The extender chamber 68 remains sealed from the retractor chamber 70 by the sealing action of the shoulder 88.

Figure 5C:
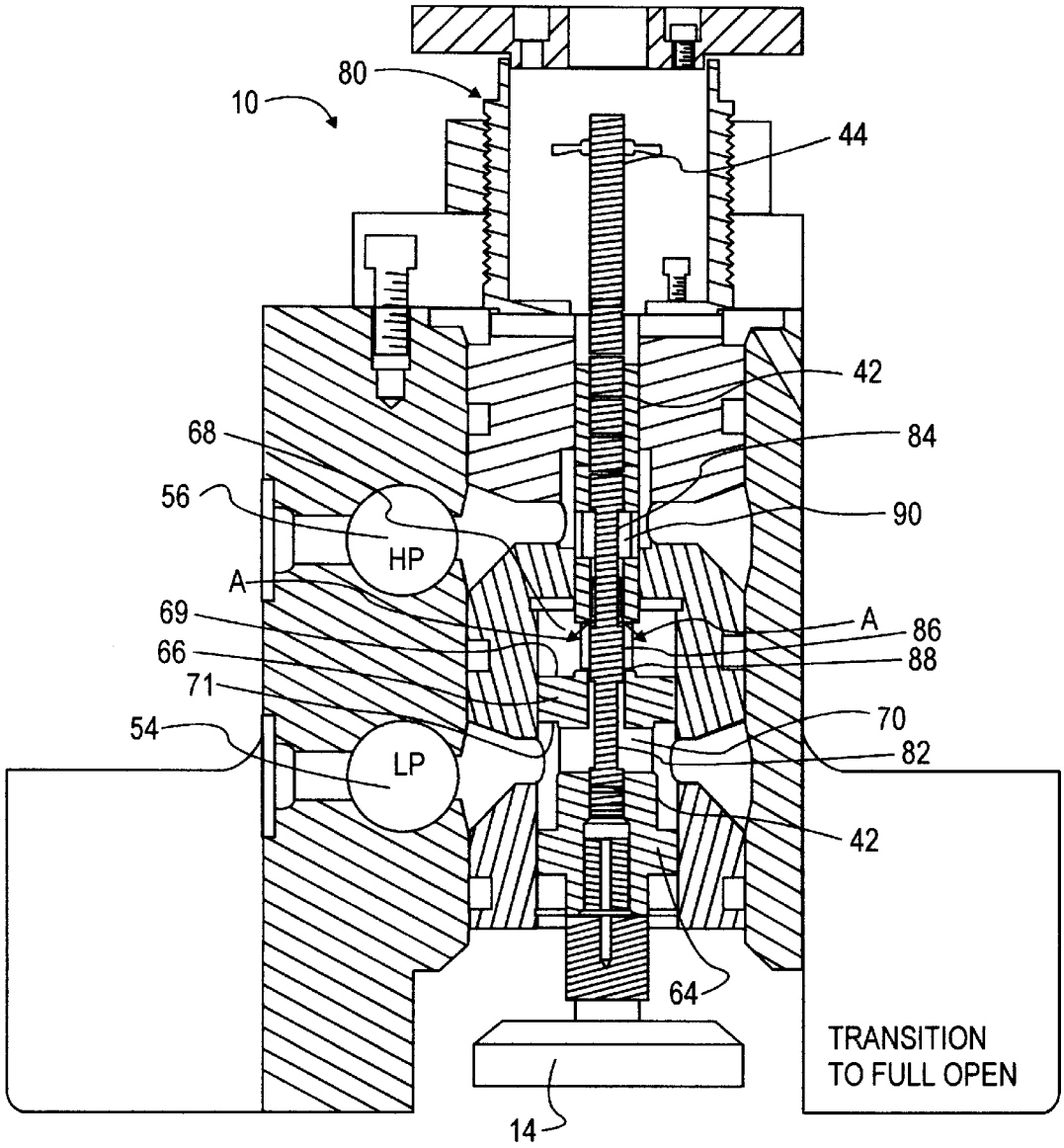
FIG. 5*c* is a side elevational view in section of the valve actuator with the actuator needle in a downward position and the valve approaching the open extended configuration.

FIG. 5*c* depicts the valve 14 as the valve 14 approaches the downward, fully open, unseated position. In the depiction of FIG. 5*c*, the needle 44 has translated downward its full travel. The actuator piston 42 lags slightly behind the needle 44. Accordingly, as indicated by arrows A, high pressure engine lubricating oil continues to flood the extender chamber 68 and to act on the extender surface 69, thereby urging the actuator piston 42 and the valve 14 in the downward direction.

Figure 5D:
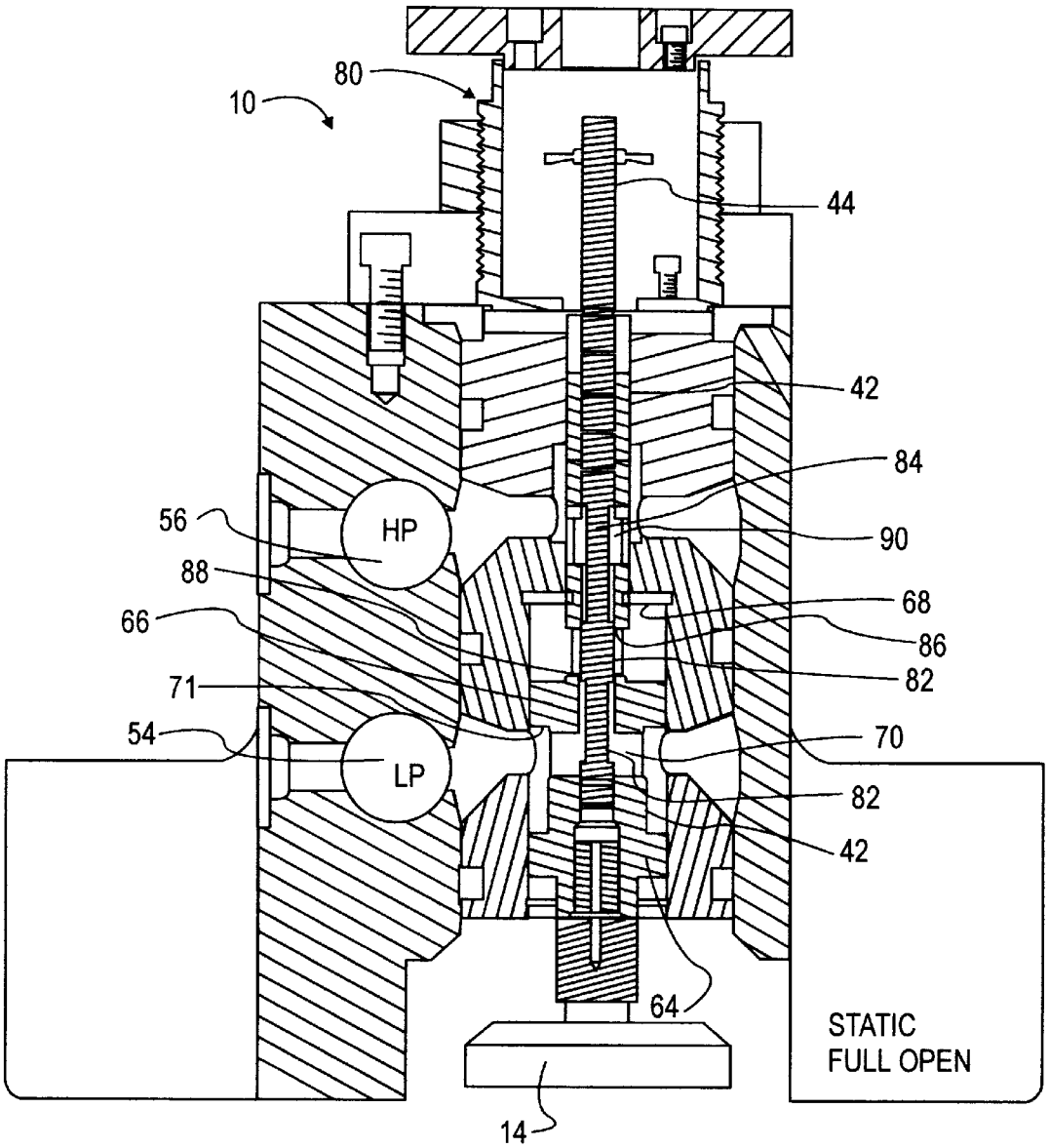
FIG. 5*d* is a side elevational view in section of the valve actuator with the actuator needle and the valve stopped in the open extended configuration.

FIG. 5*d* depicts the valve 14, the actuator piston 42, and the needle 44 all in their fully downward positions. As compared to FIG. 5*c*, the actuator piston 42 has continued to translate downward relative to the needle 44. Such translation seals the extender chamber 68 by the action of the shoulder 86 of the needle 44 again sealingly engaging the actuator piston 42. In this position, there is no flow of either high pressure engine lubricating oil or low pressure engine lubricating oil. Additionally, the shoulder 88 of the needle 44 is in sealing engagement with the actuator piston 42, thereby isolating the retractor chamber 70 from the extender chamber 68. This is essentially a static position. High pressure engine lubricating oil is sealed within the extender chamber 68 creating a hydraulic lock preventing the lower pressure engine lubricating oil acting on the retractor surface 71 of the piston head 66 in combination with the valve spring 26 from moving the actuator piston 42 in an upward direction.

Figure 5E:
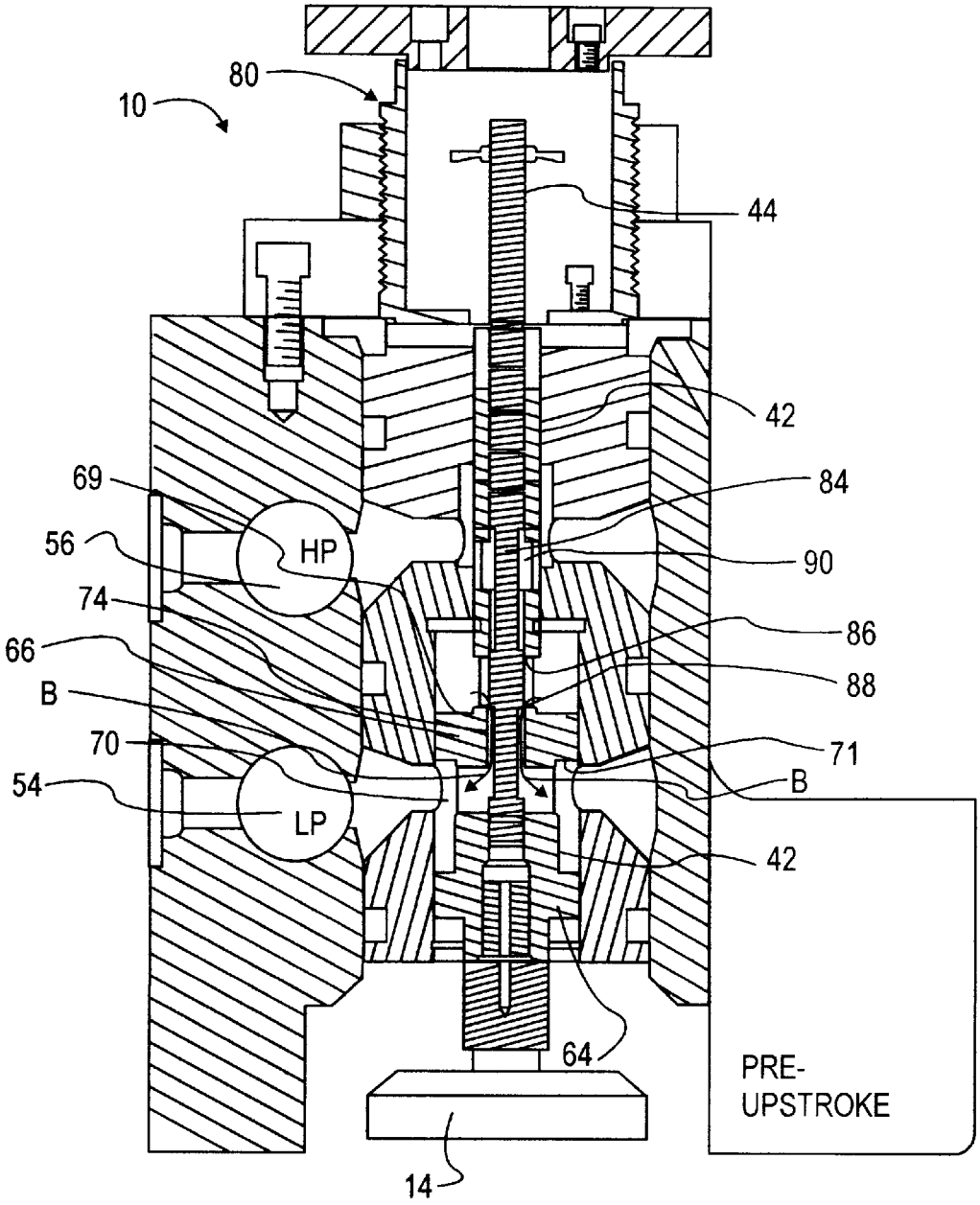
FIG. 5*e* is a side elevational view in section of the valve actuator with the actuator needle commencing upward retraction and the valve in the open extended configuration.

Referring to FIG. 5*e*, the commencement of the upstroke of the valve 14 is depicted. In FIG. 5*e*, the needle 44 has translated upward slightly under the influence of the needle positioning mechanism 80. Such upward translation backs the shoulder 88 out of the sealing engagement with the actuator piston 42. The shoulder 86 remains in sealing engagement with the actuator piston 42. The translation of the needle 44 opens a fluid passageway from the extender chamber 68 through the first groove 82 and then through to the retractor chamber 70. The pressure of the high pressure engine lubricating oil trapped in the extender chamber 68 is dissipated into the retractor chamber 70 as indicated by the arrows B. With the dissipation of the hydraulic lock as depicted in FIG. 5*d*, the bias of the valve spring 26 is free to act on the valve 14 and the actuator piston 42.

Figure 5F:
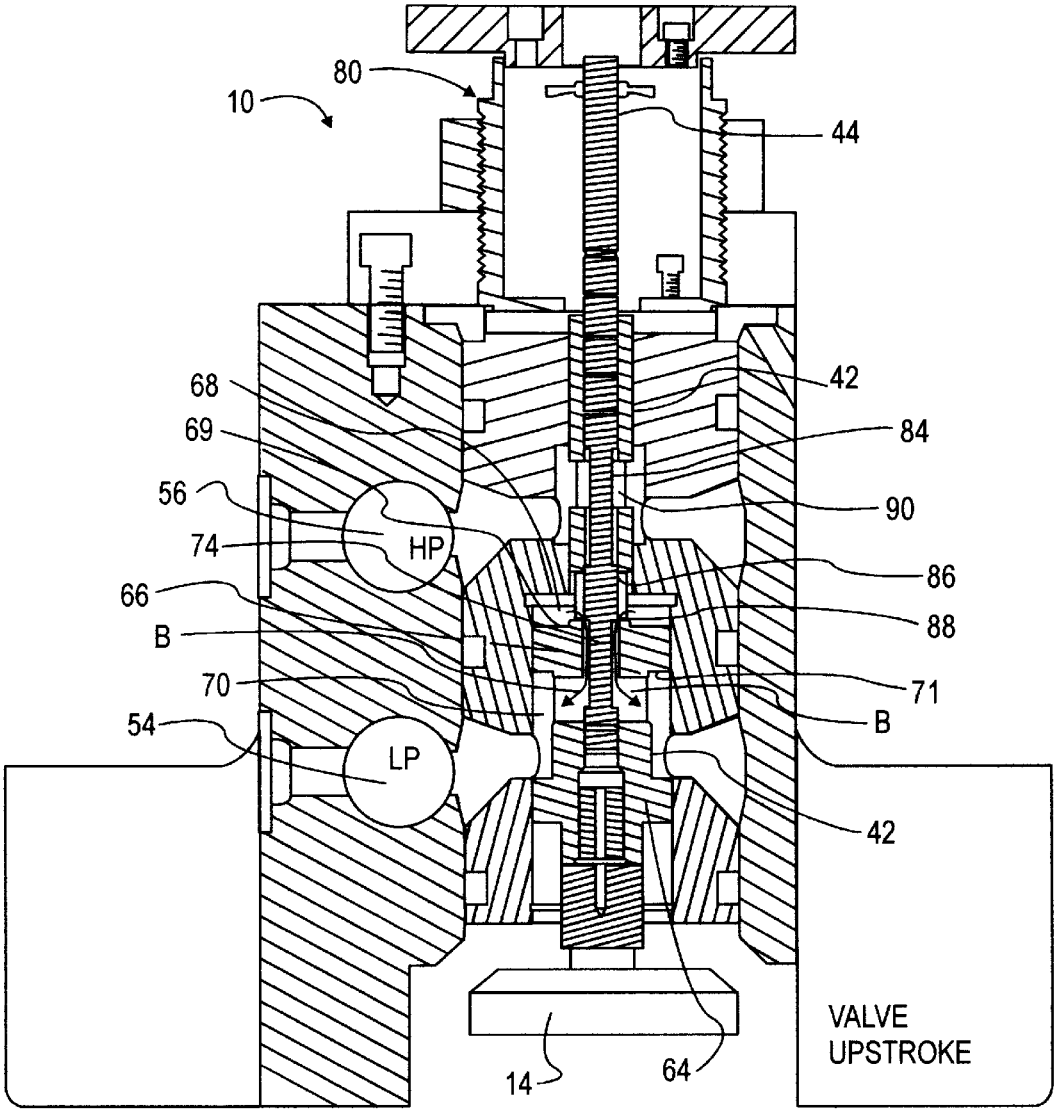
FIG. 5*f* is a side elevational view in section of the valve actuator with the actuator needle and valve in the open extended configuration, the actuator needle having retracted upward exposing the extender chamber to low pressure hydraulic fluid and the valve in the closed retracted configuration.

Referring to FIG. 5*f*, the upward bias of the valve spring 26 acting on the valve 14 forces the actuator piston 42 upward. The upward motion of the actuator piston 42 displaces substantially all the engine lubricating oil from the extender chamber 68. As indicated in FIG. 5*f*, the shoulder 88 is disengaged from the actuator piston 42 to permit the continued flowing of engine lubricating oil from the extender chamber 68 to the retractor chamber 70. The needle 44 retracts upward with the actuator piston 42 causing the shoulder 86 to maintain a sealing engagement with the actuator piston 42, thereby isolating the high pressure engine lubricating oil from the extender chamber 68. This completes the upstroke of the valve 14.

Variations within the spirit and scope of the invention described are equally comprehended by the foregoing description are equally comprehended.

What is claimed is:

1. A hydraulically-assisted engine valve actuator for assisting in the actuation of a valve, comprising:

an actuator piston being operably coupled to the valve; and a translatable needle valve being in fluid communication with a source of hydraulic fluid under pressure and with the actuator piston and further being operably coupled to a needle positioning mechanism, the needle valve being translatable at a desired and variable rate and effecting the metering of hydraulic fluid under pressure to and from the actuator piston in response to translational control inputs from the needle positioning mechanism, the metered hydraulic fluid at least partially effecting translational motion of the actuator piston to follow the translation of the needle valve to effect a desired profile of translational opening and closing motion of the valve.

2. The hydraulically-assisted engine valve actuator of claim 1, the engine Valve being translatable between a closed position and an open position and including a valve spring acting to bias the engine valve in the closed position, wherein the actuator piston acts to counter the bias exerted by the valve spring on the engine valve.

3. The hydraulically-assisted engine valve actuator of claim 2 wherein the actuator piston overcomes the bias exerted by the valve spring to effect an opening translation of the valve.

4. The hydraulically-assisted engine valve actuator of claim 3 wherein the rate of translation of the needle valve is related to the rate of translation of the actuator piston to effect a desired opening profile of the engine valve.

5. The hydraulically-assisted engine valve actuator of claim 2 wherein the actuator piston resists the bias exerted by the valve spring to effect a closing translation of the valve.

6. The hydraulically-assisted engine valve actuator of claim 5 wherein the rate of translation of the needle valve is related to the rate of translation of the actuator piston to effect a desired closing profile of the engine valve.

7. The hydraulically-assisted engine valve actuator of claim 1 wherein the needle valve has a generally elongate cylindrical shape and has a first end defining a first end groove and a second end opposed thereto, the second end being operably coupled to the needle positioning mechanism, a second groove being defined between the first and second ends thereof.

8. The hydraulically-assisted engine valve actuator of claim 1 wherein the translatable needle valve is translated by force of less than twelve pounds.

9. The hydraulically-assisted engine valve actuator of claim 1 wherein the actuator piston is translated by a hydraulic fluid exerting a force of more than four hundred pounds per square inch.

10. The hydraulically-assisted engine valve actuator of claim 1 wherein the needle positioning mechanism is selected from mechanisms consisting of a solenoid, a cam lobe, and a stepper motor.

11. The hydraulically-assisted engine valve actuator of claim 1 wherein the actuator piston has a generally elongate cylindrical shape and has a first end operably coupled to the engine valve and a second end opposed thereto, an axial bore being defined in the actuator piston extending from the second end at least a portion of a longitudinal dimension of the actuator piston.

12. The hydraulically-assisted engine valve actuator of claim 11 further including an actuator casing, the actuator casing having an axial cylinder bore defined therein, wherein the actuator piston has a piston head, the piston head being translatably disposed in the cylinder bore.

13. The hydraulically-assisted engine valve actuator of claim 12 wherein the actuator casing is fluidly coupled to a first source of relatively high pressure hydraulic fluid and is fluidly coupled to a second source of relatively low pressure hydraulic fluid.

14. The hydraulically-assisted engine valve actuator of claim 12 wherein the needle valve has a generally elongate cylindrical shape and has a first end defining a first end groove and a second end opposed thereto, the second end being operably coupled to the needle positioning mechanism, a second groove being defined between the first and second ends thereof, the needle valve being translatably disposed the axial bore defined in the actuator piston.

15. The hydraulically-assisted engine valve actuator of claim 14 wherein the needle valve first end groove and the second groove act to meter hydraulic fluid to and from the actuator piston head responsive to translation of the needle valve relative to the actuator piston.

16. A valve actuation system for an internal combustion engine, the engine having at least one engine valve, the at least one engine valve being translatable between a closed position and an open position and including a valve spring acting to bias the engine valve in the closed position, comprising:

means for supplying hydraulic fluid at a first pressure to a hydraulically-assisted engine valve actuator;

means for supplying hydraulic fluid at a second pressure to the hydraulically-assisted engine valve actuator, the second pressure being elevated with respect to the first pressure; and a hydraulically-assisted engine valve actuator for assisting in the actuation of the at least one engine valve being in fluid communication with the means for supplying hydraulic fluid at a first pressure and with the means for supplying hydraulic fluid at a second pressure, having a translatable pilot valve being operably coupled to and controlled by a pilot valve positioning system, and having a servo piston being in fluid communication with the pilot valve and being operably coupled to the engine valve, the pilot valve positioning system controlling translation of the pilot valve to meter hydraulic fluid to and from the servo piston, the hydraulic fluid acting to cause the servo piston to closely follow the translation of the pilot valve to at least partially effect a desired profile of translational opening and closing motion of the at least one engine valve.

17. A hydraulically-assisted engine valve actuator for assisting in the actuation of an engine valve, comprising:

a translatable pilot valve being operably coupled to and controlled by a pilot valve positioning system; and a servo piston being in fluid communication with the pilot valve and being operably coupled to the engine valve, the pilot valve positioning system controlling translation of the pilot valve to meter hydraulic fluid under pressure to and from the servo piston, the hydraulic fluid under pressure causing the servo piston to closely follow the translation of the pilot valve to effect a desired profile of translational opening and closing motion of the engine valve.

18. The hydraulically-assisted engine valve actuator of claim 17, the engine valve being translatable between a closed position and an open position and including a valve spring acting to bias the engine valve in the closed position, wherein the servo piston acts to counter the bias exerted by the valve spring on the engine valve.

19. The hydraulically-assisted engine valve actuator of claim 18 wherein the servo piston overcomes the bias exerted by the valve spring to effect an opening translation of the valve.

20. The hydraulically-assisted engine valve actuator of claim 19 wherein the rate of translation of the pilot valve is related to the rate of translation of the servo piston to effect a desired opening profile of the engine valve.

21. The hydraulically-assisted engine valve actuator of claim 18 wherein the servo piston resists the bias exerted by the valve spring to effect a closing translation of the valve.

22. The hydraulically-assisted engine valve actuator of claim 21 wherein the rate of translation of the pilot valve is related to the rate of translation of the servo piston to effect a desired closing profile of the engine valve.

23. The hydraulically-assisted engine valve actuator of claim 17 wherein the translatable pilot valve is translatable at a desired and variable rate, the servo piston closely following the translation of the pilot valve to effect desired engine valve opening and closing profiles.

24. The hydraulically-assisted engine valve actuator of claim 17 wherein the translatable pilot valve is translated by force of less than twelve pounds.

25. The hydraulically-assisted engine valve actuator of claim 17 wherein the servo piston is translated by a hydraulic fluid exerting a force of more than four hundred pounds per square inch.

26. The hydraulically-assisted engine valve actuator of claim 17 wherein the pilot valve positioning system is selected from mechanisms consisting of a solenoid, a cam lobe, and a stepper motor.

27. The hydraulically-assisted engine valve actuator of claim 17 wherein the servo piston has a generally elongate cylindrical shape and has a first end operably coupled to the engine valve and a second end opposed thereto, an axial bore being defined in the servo piston extending from the second end at least a portion of a longitudinal dimension of the servo piston.

28. The hydraulically-assisted engine valve actuator of claim 27 further including an actuator casing, the actuator casing having an axial cylinder bore defined therein, wherein the servo piston has a piston head, the piston head being translatably disposed in the cylinder bore.

29. The hydraulically-assisted engine valve actuator of claim 28 wherein the actuator casing is fluidly coupled to a source of high pressure hydraulic fluid and is fluidly coupled to a source of low pressure hydraulic fluid.

30. The hydraulically-assisted engine valve actuator of claim 17 wherein the pilot valve has a generally elongate cylindrical shape and has a first end defining a first end groove and a second end opposed thereto, the second end being operably coupled to the pilot valve positioning system, a second groove being defined between the first and second ends thereof.

31. The hydraulically-assisted engine valve actuator of claim 28 wherein the pilot valve has a generally elongate cylindrical shape and has a first end defining a first end groove and a second end opposed thereto, the second end being operably coupled to the pilot valve positioning system, a second groove being defined between the first and second ends thereof, the pilot valve being translatably disposed the axial bore being defined in the servo piston.

32. The hydraulically-assisted engine valve actuator of claim 31 wherein the pilot valve first end groove and the second groove act to meter hydraulic fluid to and from the servo piston head responsive to translation of the pilot valve relative to the servo piston.

33. A method of actuation of an engine valve, comprising the steps of:

translating a pilot valve responsive to control inputs by a pilot valve positioning system;

metering hydraulic fluid under pressure to and from a servo piston by means of translation of the pilot valve relative to the servo piston;

translating the servo piston and the engine valve operably coupled thereto by means of a force exerted thereon by the hydraulic fluid under pressure, the hydraulic fluid under pressure causing the servo piston to closely follow the translation of the pilot valve to effect a desired profile of translational opening and closing motion of the engine valve.

34. The method of claim 33 wherein the force exerted on the servo piston by the hydraulic fluid under pressure acts in opposition to a force exerted by a valve spring, the valve spring exerting a bias on the engine valve to urge the engine valve into a closed position.

35. The method of claim 33 wherein the pilot valve is controlled by a force of less than twelve pounds.

36. The method of claim 33 wherein the servo piston is translated by a force of more than four hundred pounds.

37. A valve actuation system for an internal combustion engine, the engine having at least one engine valve, the at least one engine valve being translatable between a closed position and an open position and including a valve spring acting to bias the engine valve in the closed position, comprising:

means for supplying hydraulic fluid at a first pressure to a hydraulically-assisted engine valve actuator;

means for supplying hydraulic fluid at a second pressure to the hydraulically-assisted engine valve actuator, the second pressure being elevated with respect to the first pressure; and the hydraulically-assisted engine valve actuator for assisting in the actuation of the at least one valve having an actuator piston being operably coupled to the at least one valve, and having a translatable needle valve being in fluid communication with the means for supplying hydraulic fluid at a first pressure and the means for supplying hydraulic fluid at a second pressure and with the actuator piston and further being operably coupled to a needle positioning mechanism, the needle valve being translatable at a desired and variable rate and effecting the metering of hydraulic fluid at the first and second pressures to and from the actuator piston in response to translational control inputs from the needle positioning mechanism, the metered hydraulic fluid at least partially effecting translational motion of the actuator piston to closely follow the translation of the needle valve to effect a desired profile of translational opening and closing motion of the valve.

38. The valve actuation system of claim 37 wherein the means for supplying hydraulic fluid at a first pressure to the hydraulically-assisted engine valve actuator is a low pressure rail conveying engine lubricating oil.

39. The valve actuation system of claim 38 wherein the means for supplying hydraulic fluid at a second pressure to the hydraulically-assisted engine valve actuator is a high pressure rail conveying engine lubricating oil.

40. The valve actuation system of claim 16 wherein the means for supplying hydraulic fluid at a first pressure to the hydraulically-assisted engine valve actuator is a low pressure rail conveying engine lubricating oil.

41. The valve actuation system of claim 40 wherein the means for supplying hydraulic fluid at a second pressure to the hydraulically-assisted engine valve actuator is a high pressure rail conveying engine lubricating oil.

* * * * *